US011753806B2

(12) United States Patent
Gwen

(10) Patent No.: US 11,753,806 B2
(45) Date of Patent: Sep. 12, 2023

(54) DRAIN ASSEMBLY TO PREVENT CLOGS

(71) Applicant: Patrick Gwen, Houston, TX (US)

(72) Inventor: Patrick Gwen, Houston, TX (US)

( * ) Notice: Subject to any disclaimer, the term of this patent is extended or adjusted under 35 U.S.C. 154(b) by 367 days.

(21) Appl. No.: 16/809,440

(22) Filed: Mar. 4, 2020

(65) Prior Publication Data

US 2021/0277640 A1 Sep. 9, 2021

(51) Int. Cl.
*E03C 1/262* (2006.01)

(52) U.S. Cl.
CPC ..... *E03C 1/262* (2013.01)

(58) Field of Classification Search
CPC . E03C 1/262; E03C 1/26; E03C 1/264; A47K 1/14
See application file for complete search history.

(56) References Cited

U.S. PATENT DOCUMENTS 6,067,669 A 5/2000 Peterson et al.
7,150,576 B1 12/2006 Kambeyanda
8,590,065 B2 11/2013 Ali et al.
D785,767 S 5/2017 Kamegie
10,344,460 B2 7/2019 Kamegie
10,519,638 B2 * 12/2019 Schuster ..... E03C 1/262
10,570,594 B2 * 2/2020 Karnegie ..... E03C 1/262
10,870,976 B2 12/2020 Kamegie
2017/0130435 A1 5/2017 Sebolt
2018/0274218 A1 9/2018 Kamegie et al.

* cited by examiner

*Primary Examiner* — Janie M Loeppke
(74) *Attorney, Agent, or Firm* — Craft Chu PLLC; Andrew W. Chu

(57) ABSTRACT

The plug for a drain collects debris before the debris can enter the plumbing. The plug includes an outer rim; a conical core having a top cone end and a bottom core end opposite the top cone end; a cone cover being placed at the top cone end; and a plurality of cone ridges extending from the cone cover and toward the outer rim. The conical core has a conical surface with an inner side and an outer side opposite the inner side, a plurality of flow holes, and a plurality of strainer holes. Each cone ridge has a top cone ridge end larger than a bottom cone ridge end so as to form a collection ring portion on the conical surface. The conical core can have a plurality of protrusions extending outward. Debris can be collected by the protrusions at the strainer holes and at the collection ring.

20 Claims, 4 Drawing Sheets

DRAIN ASSEMBLY TO PREVENT CLOGS

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a plug for a drain. More particularly, the present invention relates to a plug to prevent clogs. The present invention further relates to a plug to collect debris in a drain attached to a pipe before the debris can enter the pipe to form a clog.

2. Description of Related Art Including Information Disclosed Under 37 CFR 1.97 and 37 CFR 1.98

Clogged pipes can lead to messy and embarrassing situations. Depending upon the severity of the clog, mechanical implements, such as plungers and snakes, can be used to unclog a blockage in a pipe. In order to prevent clogs from even forming in pipes, debris that forms clogs can be trapped at the drain leading to the pipe.

Drain plugs are known mechanical devices. Some drain plugs seal the pipe. A plug can create a water-tight seal in a drain so that both liquids and solids cannot pass into the pipe. Other plugs strain the drain, i.e. separate the solids from the liquid, while only allowing the liquid to flow into through the drain and into the pipe. Debris, such as hair and fibers, are collected in the drain. Some known drain plugs are disclosed in U.S. Pat. No. 6,067,669, issued to Peterson et al on 30 May 2000, U.S. Pat. No. 7,150,576, issued to Kambeyanda on 19 Dec. 2006, U.S. Pat. No. 8,590,065, issued to Ali et al on 26 Nov. 2013, and US Publication No. 20170130435, published for Sebolt on 11 May 2017.

The prior art drain plugs continue to encounter problems with effectiveness. When hair and other debris are trapped successfully, the holes of the drain plug become clogged. The hair collected at the bottom of the drain plug restricts water flow, so the water is diverted to pass through passageways on the cylindrical core or other center structure. These passageways have less capacity for flow than the holes on the bottom. The flow through the drain plug slows, and there is standing water in the sink or tub. There is a need for another type of device to be maintain more flow when debris and hair are successfully trapped in the drain plug. Prior art drain plugs lose efficiency and effectiveness, when debris and hair are successfully collected.

It is an object of the present invention to provide a plug for a drain.

It is another object of the present invention to provide embodiments of a plug with a conical core.

It is still another object of the present invention to provide embodiments of the conical core with the wider base on the bottom end of the plug.

It is another object of the present invention to provide embodiments of a plug with different types of holes on the conical core.

It is still another object of the present invention to provide embodiments of a plug with spike protrusions in certain flow holes on the conical core.

It is another object of the present invention to provide embodiment of a plug with an adjustable outer rim.

It is still another object of the present invention to provide embodiment of a plug with an outer rim having an expandable configuration and a collapsible configuration to seal against the drain.

It is another object of the present invention to provide embodiments of a plug with cone ridges attached to a conical core.

It is still another object of the present invention to provide embodiments of a plug with a collection ring portion formed by cone ridges on a conical core.

It is still another object of the present invention to provide embodiments of a plug with a collection ring portion formed by cone ridges inverted relative to the conical core.

It is still another object of the present invention to provide embodiment of a plug with a bottom rim having an expandable configuration and a collapsible configuration to seal against the drain.

It is an object of the present invention to provide an embodiment of a plug comprised of an ultra-high molecular weight polyethylene.

It is another object of the present invention to provide an embodiment of a plug comprised of a lubricious material for resistance to soap scum, debris, hair, and other stains.

It is another object of the present invention to provide an embodiment of a plug comprised of a material for tensile strength to maintain shape during installation and cleaning and while being installed and cleaned.

These and other objectives and advantages of the present invention will become apparent from a reading of the attached specifications and appended claims.

BRIEF SUMMARY OF THE INVENTION

Embodiments of a plug for a drain, according to the present invention, include an outer rim, a conical core, a cone cover, and a plurality of cone ridges. The conical core has a conical surface with a plurality of flow holes and a plurality of strainer holes. The plug is placed in a drain hole so that fluid with debris flows to the conical core. Debris is collected at the conical core to prevent clogs further down the drain. The flow holes and the strainer holes can be arranged in an alternating (at least one flow hole next to a strainer hole) pattern vertically and horizontally along the conical surface. The strainer holes are larger than the flow holes. The plug may also include a stopper removably attached to the cone cover, or a lid removably attached to the cone cover.

The conical core has a top cone end and a bottom core end opposite the top cone end. The outer rim is set around the conical core. The bottom core end is larger than the top core end, and the top core end is smaller than the bottom core end so as to set the orientation of the conical core. The cone cover is placed at the top cone end. The cone ridges extend from the cone cover and toward the outer rim.

In some embodiments, each cone ridge is comprised of a top cone ridge end and a bottom cone ridge end opposite the top cone ridge end. The top cone ridge end is larger than the bottom cone ridge end so as to set the orientation of the cone ridges, which is opposite the orientation of the conical core. The cone ridges form a collection ring portion on the conical surface at the bottom cone ridge end between the outer rim and the cone cover. The collection ring is the smallest diameter of the plug. The collection ring is positioned so as to focus the collection of debris at the collection ring. Debris, such as hair or other string material, can be wrapped at this collection ring and released from the plug from this collection ring.

Embodiments of the outer rim can include an inner ring with holes and an outer collet ring comprised of a plurality of pre-folded segments. The outer collet ring has an expanded configuration with the pre-folded segments spread furthest from respective adjacent segments and a collapsed configuration with at least one pre-folded segment retracted closer to an adjacent segment than the expanded configuration. There can also be vents between the inner ring and the outer ring.

The present invention may also include a plurality of protrusions extending outward from the outer side of the conical surface at respective strainer holes. In some embodiments, the spikes mounted within respective strainer holes or ridge members mounted within respective strainer holes. The spike can be mounted within the strainer hole and extended out from the outer side. The ridge member can extend outward from the outer side and borders a respective strainer hole.

Embodiments of the present invention further include the method for straining fluid through a drain. The method includes setting the plug in a drain hole. Fluid with debris flows through the top opening of the drain hole to the plug, and the fluid flows through the conical core. Debris is collected at the strainer holes on the outer side of the conical core. In some embodiments, debris is collected at the collection ring of the conical core. In some embodiments, a vortex flow can be created so as trap more debris closer to the top cone end than the bottom cone end. The method further includes removing debris from the plug, such as turning the plug inside out so as to release debris from the protrusions.

DETAILED DESCRIPTION OF THE INVENTION

Figure 1:
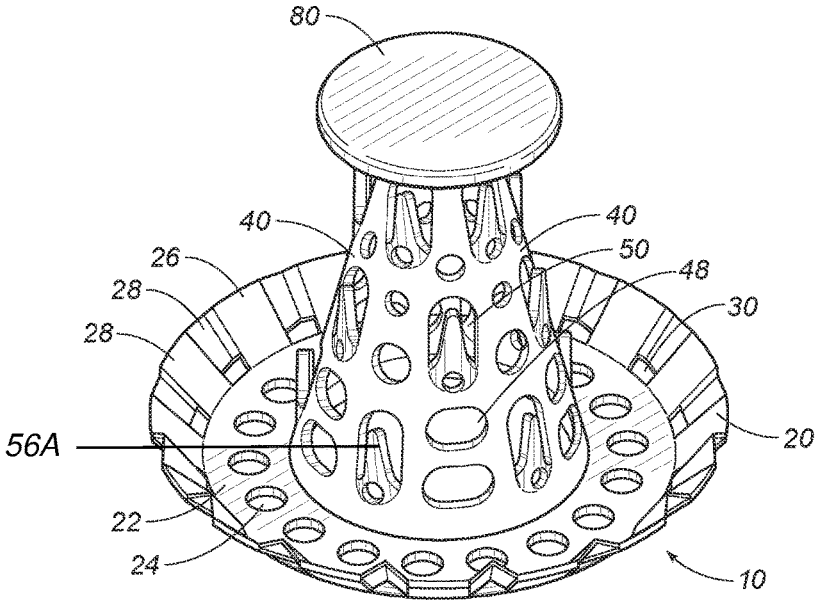
FIG. 1 is an upper perspective view of a first embodiment of the plug for a drain, according to the present invention.

FIGS. 1-7 show embodiments of the plug for a drain, according to the present invention. The plug of the present invention collects debris before the debris can enter the pipes of an entire plumbing system. Whether the plug is placed in a kitchen sink, bathroom sink, bathtub or shower, the plug of the present invention prevents clogs by stopping hair, strings, fibrous materials and other debris from being lodged within a pipe. The plug of the present invention is particularly useful for hair and string because the plug can wind these longer thread-like materials around a collection ring at the narrowest diameter of the plug. There is a focused collection point for these difficult to collect debris, which can usually slip through small holes and filters.

The embodiments of FIGS. 1-7 includes a plug 10 for a drain, comprising an outer rim 20, a conical core 40 having a top cone end 42 and a bottom cone end 44 opposite the top cone end, and a cone cover 80 being placed at the top cone end 42. The outer rim 20 is set around the conical core 40 with the bottom cone end 44 being made integral with the outer rim 20.

Figure 3:
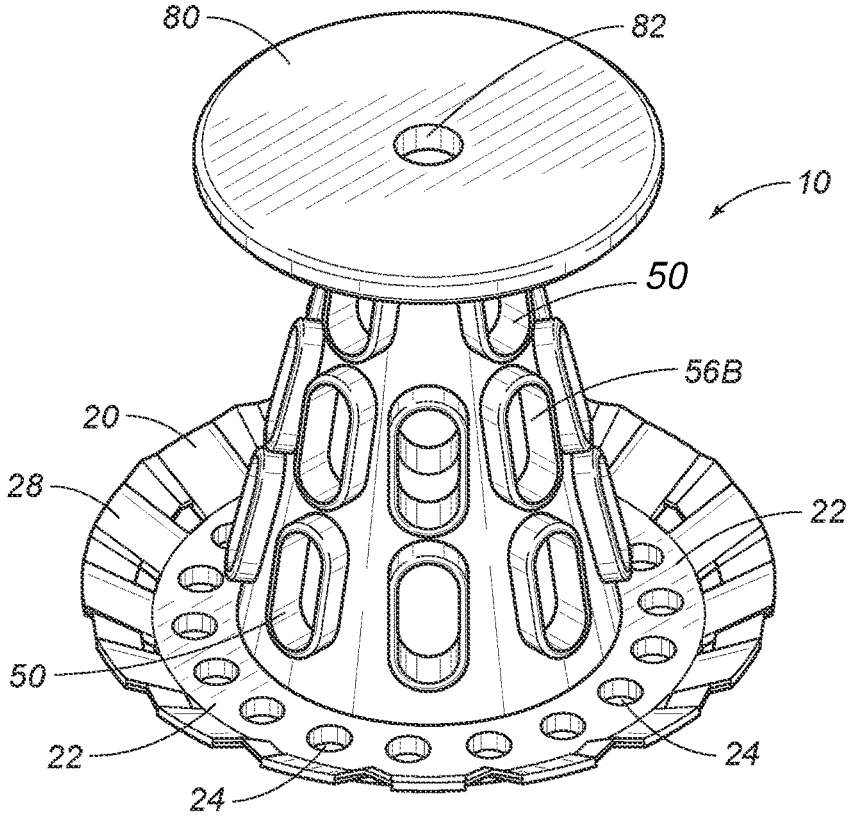
FIG. 3 is an upper perspective view of a second embodiment of the plug for a drain, according to the present invention.
Figure 4:
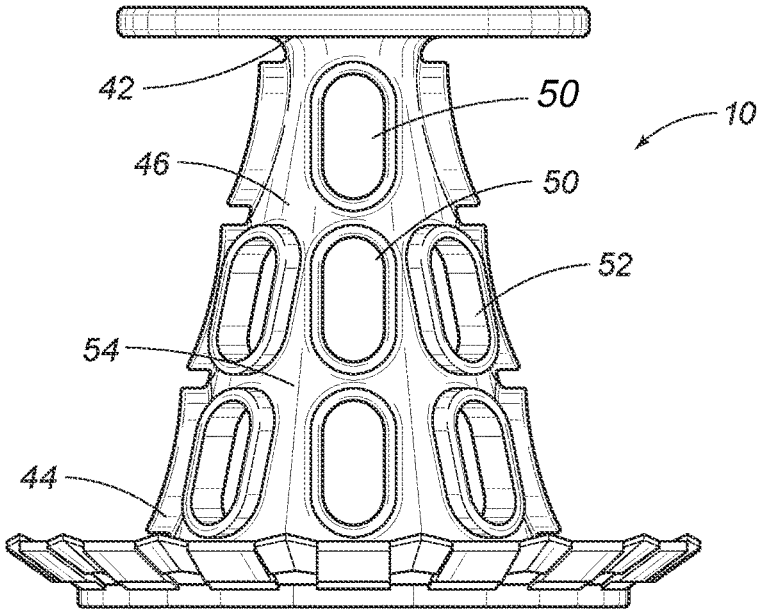
FIG. 4 is a side elevation view of the second embodiment of FIG. 3.
Figure 5:
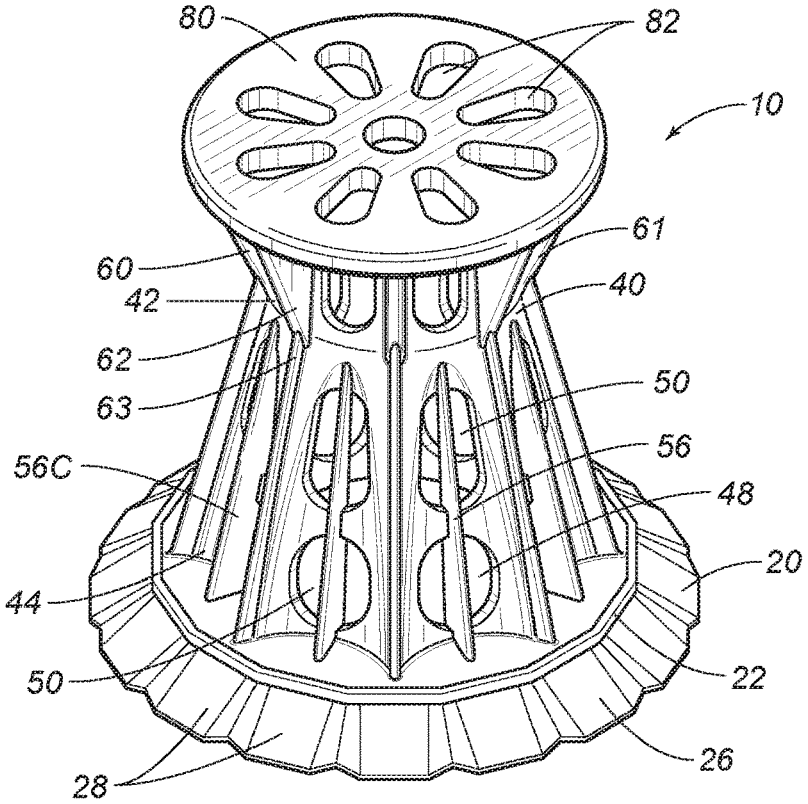
FIG. 5 is an upper perspective view of a third embodiment of the plug for a drain, according to the present invention.
Figure 6:
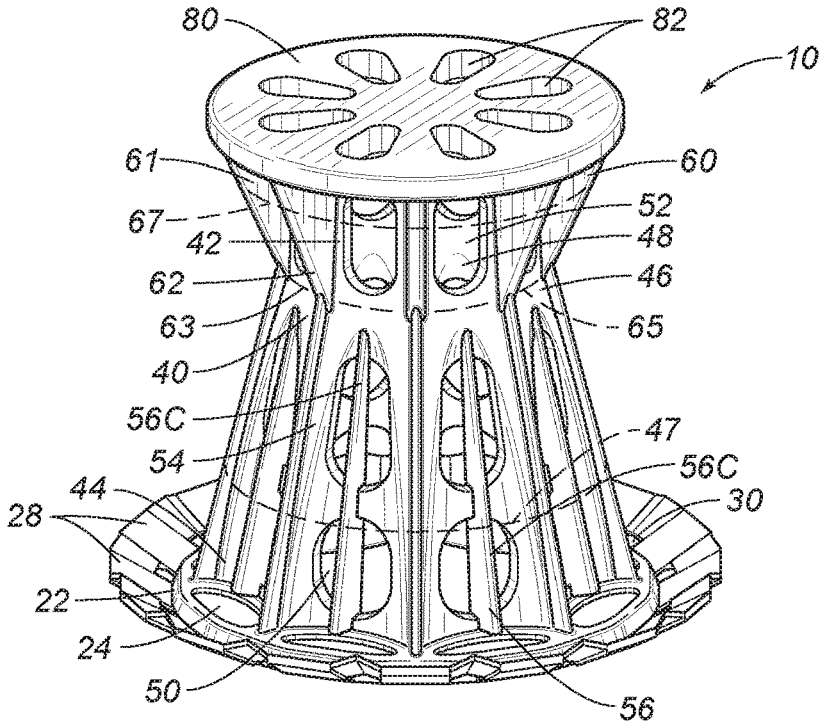
FIG. 6 is a side perspective view of the third embodiment of FIG. 5.
Figure 7:
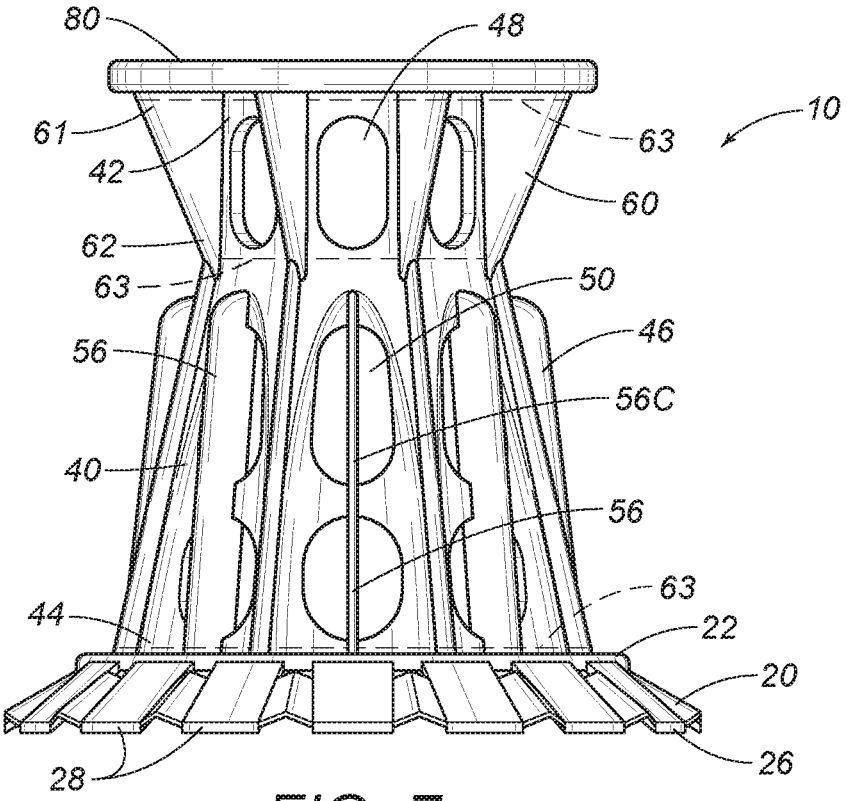
FIG. 7 is a side elevation view of the third embodiment of FIG. 5.

FIGS. 1-7 show embodiments of the outer rim 20 being comprised of an inner ring 22 and an outer collet ring 26 comprised of a plurality of pre-folded segments 28. The inner ring 22 can have rim holes 24 as in FIGS. 1-4. The outer rim 20 can have vents 30 between the outer collet ring 26 and the inner ring 22 as in FIGS. 1-7. The outer collet ring 26 has an expanded configuration with the pre-folded segments 28 spread furthest from respective adjacent segments 28 and a collapsed configuration with at least one pre-folded segment 28 retracted closer to an adjacent segment 28 than the expanded configuration. In the embodiment of FIGS. 1-4, at least one pre-folded segment 28 is closer to the top cone end 42 in the collapsed configuration. The expanded configuration and the collapsed configuration allow the plug 10 to fit in variable size drain holes. The conical core 40 is smaller than the drain hole, and the outer rim 20 easily adjusts to fit a larger drain hole in a full expanded configuration or a smaller drain hole in any collapsed configuration. The plug 10 is made of flexible material to fit and bend into any drain hole. FIGS. 1-4 show a fold-up configuration of the outer collet ring 26, and FIGS. 5-7 show a super extended fold-up configuration of the outer collet ring 26, with the pre-folded segments 28 being bent downward. In this embodiment, the pre-folded segments 28 can still be folded upward to seal the drain hole, even though the initial position is below the inner ring 22, i. e. super extended.

Figure 2:
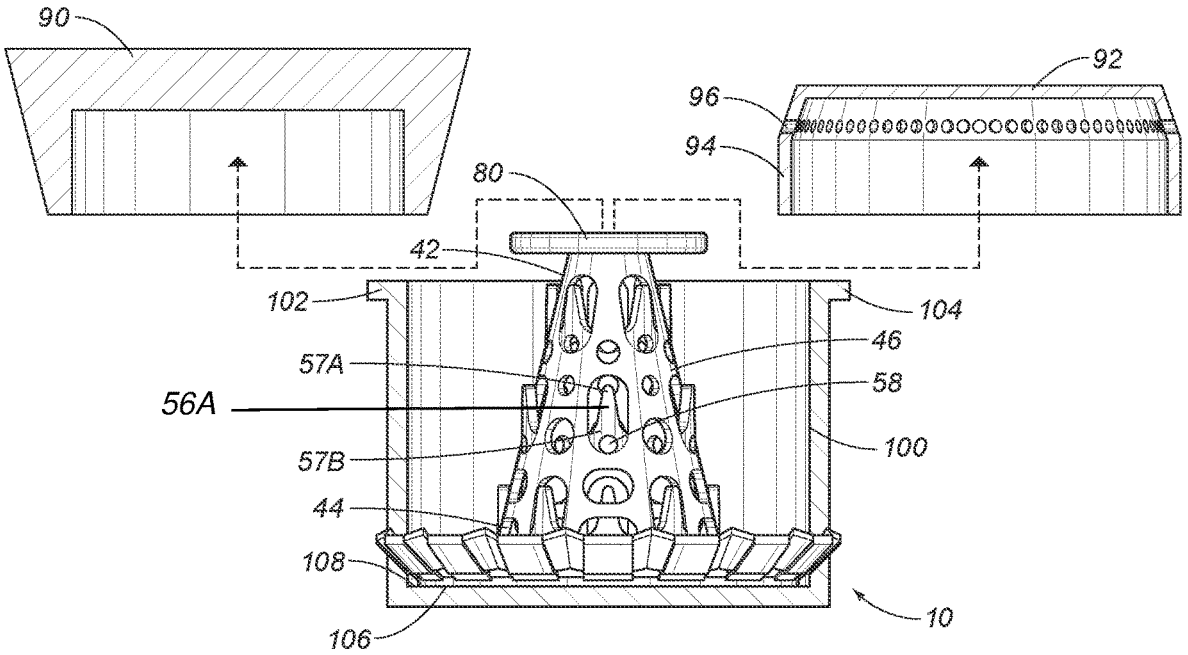
FIG. 2 is a side elevation view of the first embodiment of FIG. 1.

Embodiments of the cone cover 80 show the cone cover 80 as larger than the conical core 40 at the top cone end 42. The cone cover 80 can have openings 82, as shown in FIGS. 3-7 so as to allow fluid to pass through the plug 10 from above the plug 10. There is a single opening 82 in FIGS. 3-4, and there are multiple openings in FIGS. 5-7. FIGS. 1-2 show embodiments without openings. The bottom cone end 44 is larger than the top cone end 42, and the top cone end 42 is consequently smaller than the bottom cone end 44 so as to set the orientation of the cone shape of the conical core 40. The cone shape of the conical core 40 is upright with the smallest end being at the top and the widest end being at the bottom. The cone cover 80 can be centered above the conical core 40.

FIGS. 1-7 all show embodiments of the conical core 40 comprised of a conical surface 46 between the top cone end 42 and the bottom cone end 44, a plurality of holes 48, 50 distributed across the conical surface 46. In the embodiments of FIGS. 1-5, the plurality holes 48, 50 are comprised of a plurality of strainer holes 50 (FIGS. 3-4), a plurality of flow holes 48, or both distributed across the conical surface 46. The conical surface 46 has an inner side 52 and an outer side 54 opposite the inner side 52. In the embodiments of FIGS. 1, 2 and 5, the flow holes 48 and the strainer holes 50 are arranged in an alternating pattern (at least one flow hole next to a strainer hole) along the conical surface 46. The embodiments of FIGS. 1 and 5 show the strainer holes 50 being larger than the flow holes 48. FIGS. 3-4 show an embodiment with all flow holes 48 being strainer holes 50. FIGS. 6-7 show an embodiment with only flow holes 48.

The present invention includes a plug 10 comprising a plurality of cone ridges 60 extending from the cone cover 80 and toward the outer rim 20, as in FIGS. 5-7. FIGS. 1-4 do not show the cone ridges 60 for clarity of showing other features. The cone ridges 60 of FIGS. 5-7 are required components of any plug 10 of the present invention. Each cone ridge 60 is comprised of a top cone ridge end 61 and a bottom cone ridge end 62 opposite the top cone ridge end. The top cone ridge end 61 is larger than the bottom cone ridge end 62 so as to form a collection ring portion 63 on the conical surface 46 at the bottom cone ridge end 62 between the outer rim 20 and the cone cover 80. Additionally, the top cone ridge end 61 being larger than the bottom cone ridge end 62 sets the orientation of another cone shape of the cone ridges 60. The cone shape of the cone ridges 60 is inverted relative to the cone shape of the conical core 40. The cone shape of the cone ridges 60 have the smallest end being at the bottom and the widest end being at the top.

In these embodiments, the collection ring 63 has a collection ring diameter 65 smaller than a diameter 47 of the conical core 40 between the outer rim 20 and the bottom cone ridge end 62. The collection ring diameter 65 is also smaller than a diameter 67 formed by the cone ridges 60. The collection ring 63 as the smaller diameter becomes the main collection area for debris such as hair. As thread like material wraps around and tightens, the cone shape of the conical core 40 and the cone shape of the cone ridges 60 focus the debris to the collection ring 63. Even if the debris is twisted or not wrapped completely around the collection ring 63, at least a portion of the debris can be wrapped at the collection ring 63. As focuses on the collection ring 63, there is now a larger gathering of debris to be isolated and removed.

Alternate embodiments of the present invention include a plurality of protrusions 56 extending outward from the outer side 54 of the conical surface 46, as shown in FIGS. 1-5. In these embodiments, the protrusions 56 are at respective strainer holes 50. The distinguishing feature of a strainer hole 50 is the association with a protrusion 56, which strains or filters fluid with debris. The strainer hole 50 has a respective protrusion 56 as an obstruction to fluid flow and to debris. Debris can be collected at the protrusion 56 at the strainer hole 50. Other flow holes 48 allow fluid and fluid with debris to pass through the plug 10.

FIGS. 1-2 show embodiments of the protrusions 56 as spikes 56A mounted within respective strainer holes 50. At least one spike 56A is mounted within the strainer hole 50 and extended out from the outer side 54. In these embodiments, each spike is comprised of a point end 57A and a base end 57B opposite the point end. The base end 57B is wider than the point end 57A. FIGS. 1-2 also show each spike 56A being comprised of a through hole 58 in a respective base end 57B, and each spike being arranged closer to an adjacent spike at the top cone end 42 than at the bottom cone end 44.

FIGS. 3-4 show embodiments of the protrusions 56 as ridge members 56B mounted within respective strainer holes 50. Each ridge member 56B extends outward from the outer side 54 and borders a respective strainer hole 50. FIGS. 3-4 also show each ridge member being arranged closer to an adjacent ridge member at the top cone end 42 than at the bottom cone end 44.

FIG. 5 show embodiments of the protrusions 56 as rib member 56C mounted across respective strainer holes 50. Each rib member 56C can cross at least one strainer hole 50. The rib members 56C can also form a portion of the cone shape of the conical core 40, which also supports of orientation of the cone shape of conical core 40 relative to the inverted cone shape of the cone ridges 60.

Further alternate embodiments include the plug 10 of the present invention with attachments, including a stopper 90 or lid 92 removably attached to the cone cover 80. The stopper 90 can cover the conical core 40 so as to seal liquid from passing through the conical core 40 and the outer rim 20. The plug 10 can be sealed in the drain hole. Embodiments of the lid 92 include the lid 92 having a peripheral rim 94 with a perforated ridge 96. The lid 92 covers the conical core 40, while liquid passes through the perforated ridge 96 to the outer rim 20.

Embodiments of the present invention include the method for straining fluid through a drain. The method includes the steps of setting the plug 10 in a drain hole 100 having a top opening 102 with a top edge 104 and a bottom hole 106 opposite the top opening with bottom supports 108, flowing fluid with debris through the top opening 102 to the plug, flowing fluid through the conical core 40, and collecting debris at the collection ring 63. As shown in FIG. 2, some embodiments of the method include the outer rim 20 being placed on the bottom supports 108. In the embodiments of the plug 10 with protrusions 56 and respective strainer holes 50, the method further comprises retaining debris on the protrusions at respective strainer holes.

Alternate embodiments of the method of the present invention include the step of removing debris from the plug. In particular, the step of removing debris from the plug comprises the step of turning the plug inside out so as to release debris from the collection ring. Embodiments of the step of flowing fluid with debris comprises the step of creating a vortex flow along the conical surface 46 from top cone end 42 to bottom cone end 44 with flow rates faster at the bottom cone end 44 than at the top cone end 42 so as trap more debris closer to the top cone end 42 than the bottom cone end 44. The cone shape of the conical core 40 controls fluid flow different from the prior art cylindrical cores. The volume created around the plug by the drain hole is no longer equal from top to bottom. In the prior art, the debris would settle to the bottom of the plug, eventually clogging the holes on the bottom of the plug. In the vortex flow of the present invention, debris is centered at the collection ring so that holes 24 on the outer rim 20 and flow holes 48 on the bottom cone end 44 are not clogged. The fluid flow through the plug 10 of the present invention is no longer clogged itself.

The present invention is a plug for a drain with an outer rim, a conical core, and cone ridges. The conical core has a wider base on the bottom end of the plug. The cone ridges have wider cone edges at the top end of the plug. The cone shape of the conical core and the cone shape of the cone ridges are inverted relative to each other so as to form a collection ring on the conical surface. Thread like debris is gathered at the collection ring for easier removal and prevention of clogging the plug itself. The outer rim is adjustable to fit different drain holes. An expandable configuration fits larger drain holes, and a collapsible configuration fits smaller drain holes so as to seal against different drain holes.

The present invention also includes different types of holes on the conical core. In particular, there are flow holes for passing fluid, but there can also be strainer holes associated with protrusions, such as spikes, ridges, or ribs. The protrusions are additional collection areas for debris.

In some embodiments, the is plug comprised of an ultra-high molecular weight polyethylene. The plug is flexible to seal and flexible to be turned inside out for removal of debris. Thread like debris, such as hair, can be released from the collection ring by turning the plug inside out. The material composition can also be a lubricious material for resistance to soap scum, debris, hair, and other stains. The material composition has tensile strength to maintain shape during installation and cleaning and while being installed and cleaned.

The foregoing disclosure and description of the invention is illustrative and explanatory thereof. Various changes in the details of the illustrated structures, construction and method can be made without departing from the true spirit of the invention.

I claim:

1. A plug for a drain, comprising:

an outer rim;

a conical core having a top cone end and a bottom cone end opposite said top cone end, said outer rim being set around said conical core, said bottom cone end being made integral with said outer rim, said bottom cone end being larger than said top cone end, said top cone end being smaller than said bottom cone end, wherein said conical core is comprised of:

a conical surface between said top cone end and said bottom cone end, said conical surface having an inner side and an outer side opposite said inner side, and a plurality of holes distributed across said conical surface;

a cone cover being placed at said top cone end, said cone cover being larger than said conical core at said top cone end; and a plurality of cone ridges extending from said cone cover and toward said outer rim, wherein each cone ridge is comprised of a top cone ridge end and a bottom cone ridge end opposite said top cone ridge end, said top cone ridge end being larger than said bottom cone ridge end so as to form a collection ring portion on said conical surface at said bottom cone ridge end between said outer rim and said cone cover, wherein said collection ring having a collection ring diameter smaller than a diameter of said conical core between said outer rim and said bottom cone ridge end, and wherein said collection ring diameter is smaller than a diameter formed by said cone ridges.

2. The plug, according to claim 1, wherein said outer rim is comprised of an inner ring and an outer collet ring comprised of a plurality of pre-folded segments.

3. The plug, according to claim 2, wherein said outer collet ring has an expanded configuration with the pre-folded segments spread furthest from respective adjacent segments and a collapsed configuration with at least one pre-folded segment retracted closer to an adjacent segment than said expanded configuration.

4. The plug, according to claim 3, wherein at least one pre-folded segment is closer to said top cone end in said collapsed configuration than in said expanded configuration.

5. The plug, according to claim 2, further comprising:

vents between said inner ring and said outer collet ring; and a plurality of rim holes in said inner ring.

6. The plug, according to claim 1, wherein said plurality of holes are comprised of a plurality of strainer holes and a plurality of flow holes, wherein said flow holes and said strainer holes are arranged in an alternating pattern along said conical surface.

7. The plug, according to claim 6, said strainer holes being larger than said flow holes.

8. The plug, according to claim 1, further comprising:

a plurality of protrusions extending outward from said outer side of said conical surface, wherein said plurality of holes is comprised of a plurality of strainer holes, wherein said protrusions extend outward from said outer side of said conical surface at respective strainer holes, wherein said protrusions are comprised of spikes mounted within respective strainer holes, and wherein at least one spike is mounted within said strainer hole and extended out from said outer side.

9. The plug, according to claim 8, wherein each spike is comprised of a point end and a base end opposite said point end, said base end being wider than said point end.

10. The plug, according to claim 9, wherein each spike is comprised of a through hole in a respective base end.

11. The plug, according to claim 8, wherein each spike is arranged closer to an adjacent spike at said top cone end than at said bottom cone end.

12. The plug, according to claim 1, further comprising:

a plurality of protrusions extending outward from said outer side of said conical surface, wherein said plurality of holes is comprised of a plurality of strainer holes, each protrusion of said plurality of protrusions being at respective strainer holes, wherein said protrusions are comprised of ridge members mounted within respective strainer holes, and wherein at least one ridge member extends outward from said outer side and borders a respective strainer hole.

13. The plug, according to claim 12, wherein each ridge member is arranged closer to an adjacent ridge member at said top cone end than at said bottom cone end.

14. The plug, according to claim 1, wherein said cone cover is centered above said conical core.

15. The plug, according to claim 1, further comprising:

a stopper removably attached to said cone cover, said stopper covering said conical core so as to seal liquid from passing through said conical core and said outer rim.

16. The plug, according to claim 1, further comprising:

a lid removably attached to said cone cover, said lid having a peripheral rim with a perforated ridge, said lid covering said conical core so as to pass liquid through said perforated ridge and said conical core and said outer rim.

17. A method for straining fluid through a drain, comprising the steps of:

setting said plug, according to claim 1, in a drain hole having a top opening with a top edge and a bottom hole opposite said top opening with bottom supports, said outer rim being placed on said bottom supports;

flowing fluid with debris through said top opening to said plug;

flowing fluid through said conical core; and collecting debris at said collection ring.

18. The method of claim 17, wherein said plug further comprises a plurality of protrusions extending outward from said outer side of said conical surface, wherein said plurality of holes is comprised of a plurality of strainer holes, and wherein said protrusions extend outward from said outer side of said conical surface at respective strainer holes, further comprising the steps of:

retaining debris on said protrusions at respective strainer holes.

19. The method of claim 17, wherein the step of flowing fluid with debris comprises the step of:

creating a vortex flow along the conical surface from top cone end to bottom cone end with flow rates faster at said bottom cone end than at said top cone end so as trap more debris closer to said top cone end than said bottom cone end.

20. The method of claim 17, further comprising the step of:

removing debris from said plug.

* * * * *